US006702283B2

(12) United States Patent
Berlingen et al.

(10) Patent No.: US 6,702,283 B2
(45) Date of Patent: Mar. 9, 2004

(54) DEVICE FOR DECURLING FLAT PRINTING MATERIALS

(75) Inventors: Detlev Berlingen, Heidelberg (DE); Dieter Gauert, Edingen (DE); Michael Reschauer, Heidelberg (DE); Ralf Steinmetz, Edingen (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/106,592

(22) Filed: Mar. 26, 2002

(65) Prior Publication Data

US 2002/0164183 A1 Nov. 7, 2002

(30) Foreign Application Priority Data

Mar. 26, 2001 (DE) ..... 101 14 851

(51) Int. Cl.[7] ..... B65H 5/02; B65H 5/04; G03G 15/00

(52) U.S. Cl. ..... 271/276; 399/406

(58) Field of Search ..... 162/197, 271; 399/406; 271/226

(56) References Cited

U.S. PATENT DOCUMENTS 4,013,284 A * 3/1977 Demetre ..... 271/183
4,060,236 A * 11/1977 Carstedt ..... 271/183
6,179,285 B1 * 1/2001 Teumer et al. ..... 271/194

FOREIGN PATENT DOCUMENTS

| | | |
|---|---|---|
| DE | 24 27 280 | 12/1975 |
| DE | 26 29 421 | 1/1977 |
| DE | 28 38 586 | 3/1980 |

* cited by examiner

*Primary Examiner*—Donald P. Walsh
*Assistant Examiner*—Kenneth W. Bower
(74) *Attorney, Agent, or Firm*—Laurence A. Greenberg; Werner H. Sytemer; Gregory L. Mayback

(57) ABSTRACT

A device for decurling flat printing materials for a machine for processing the printing materials has a guide surface section whereover the printing materials are drawable. The guide surface section are formed with a decurling notch, and with suction openings arranged along and in the decurling notch and penetrating the guide surface section, and an evacuation system fluidically connected to the suction openings. The suction openings are formed in successive groups thereof, and the evacuation system including a plurality of chambers, of which respective chambers are assigned to a respective one of the groups of suction openings, the chambers being selectively settable with at least one of equal and unequal negative pressures therein during operation, and a machine for processing the printing materials having the decurling device therein.

8 Claims, 4 Drawing Sheets

DEVICE FOR DECURLING FLAT PRINTING MATERIALS

BACKGROUND OF THE INVENTION

FIELD OF THE INVENTION

The invention relates to a device for decurling flat printing materials, in particular, printed sheets, for a machine for processing the printing materials, in particular, a sheet-processing rotary printing machine having a guide surface section formed with a decurling notch over which the printing materials are drawn, suction openings arranged along and in the decurling notch and penetrating the guide surface section, an evacuation system fluidically connected to the suction openings, and also a machine equipped with the evacuation system and serving for processing flat printing materials, in particular, a sheet-processing rotary printing machine.

A device of the foregoing general type is disclosed, for example, by the published German Patent Document DE 26 29 421 C2. The suction openings of this heretoforeknown device have, for each 30 cm length of the decurling notch, a total cross section lying within a range between only 0.3 and 1.0 $cm^2$. Relatively low leakage is, in fact, attained therewith in the case wherein the printing materials to be decurled do not cover all of the suction openings due to the format of the printing materials, a most extensive planar shaping of the printing materials by smoothing the printing materials being unachievable with this conventional device, in particular when the printing materials, due to corresponding printing thereof, exhibit successive regions along the decurling notch with considerable differences in ink layer thickness and when, in the case of particular print jobs, for example, an area printed over the entire surface and possibly with a great ink layer thickness is followed by an unprinted area. Trouble-free further processing of printed sheets, for example in the form of operations such as cutting, punching, folding, stapling and so forth, demands that the form of the printing materials be as planar or flat as possible, however.

SUMMARY OF THE INVENTION

It is an object of the invention to provide a device for decurling flat printing products, which are created by a rotary printing machine for processing flat printing materials, for trouble-free further processing. In this regard, it is an object of the invention to provide a device of the general type mentioned at the introduction hereto wherein, after the printing materials have passed the decurling notch, they have the flattest possible form, independent of subject-induced conditions. With the foregoing and other objects in view, there is provided, in accordance with one aspect of the invention, a device for decurling flat printing materials for a machine for processing the printing materials, comprising a guide surface section whereover the printing materials are drawable, the guide surface section being formed with a decurling notch, and with suction openings arranged along and in the decurling notch and penetrating the guide surface section, and an evacuation system fluidically connected to the suction openings, the suction openings being formed in successive groups thereof, and the evacuation system including a plurality of chambers, of which respective chambers are assigned to a respective one of the groups of suction openings, the chambers being selectively settable with equal and unequal negative pressures therein during operation.

In accordance with another feature of the invention, a vacuum generator is assigned to each of the chambers, the vacuum generator having a controllable gradient.

In accordance with a further feature of the invention, the chambers include a central chamber and an outer chamber on each side thereof, mutually adjacent chambers of said central and said outer chambers being connected to one another via a throttle, the decurling device further comprising a vacuum generator connected to said central chamber, and controllable valves, respectively, via which each of said outer chambers is connected to atmosphere.

In accordance with an added feature of the invention, the vacuum generator has a controllable vacuum gradient.

In accordance with an additional feature of the invention, the central chamber connected to the vacuum generator is also connected to a bypass open to the atmosphere and having one of the controllable valves inserted therein.

In accordance with yet another feature of the invention, a respective one of the chambers is connected via a throttle to a vacuum generator common to the chambers and, respectively, to a bypass open to atmosphere, a respective controllable valve being inserted into the respective bypass.

In accordance with yet a further feature of the invention, the printing materials are printed sheets, and the machine for processing the printing materials is a sheet-processing rotary printing machine.

In accordance with a concomitant aspect of the invention, there is provided a machine for processing flat printing materials having a device for decurling flat printing materials in the machine, comprising a guide surface section whereover the printing materials are drawable, the guide surface section being formed with a decurling notch, and with suction openings arranged along and in the decurling notch and penetrating the guide surface section, and an evacuation system fluidically connected to the suction openings, the suction openings being formed in successive groups thereof, and the evacuation system including a plurality of chambers, of which respective chambers are assigned to a respective one of the groups of suction openings, the chambers being selectively settable with equal and unequal negative pressures therein during operation.

Thus, in order to achieve the object of the invention, provision is made for the suction openings to form successive groups, and for the evacuation system to comprise a plurality of chambers, of which a respective chamber is assigned to a respective one of the groups of suction openings, and for equal or unequal negative pressures to be selectively or optionally settable in the chambers.

With this construction, printing material passing the decurling notch can be deformed differently zonally, and it is possible to refrain zonally from any deformation, a respective zone having an extent along the decurling notch which corresponds at least approximately to the corresponding extent of a respective group of suction openings.

Other features which are considered as characteristic for the invention are set forth in the appended claims.

Although the invention is illustrated and described herein as embodied in a device for decurling flat printing materials, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
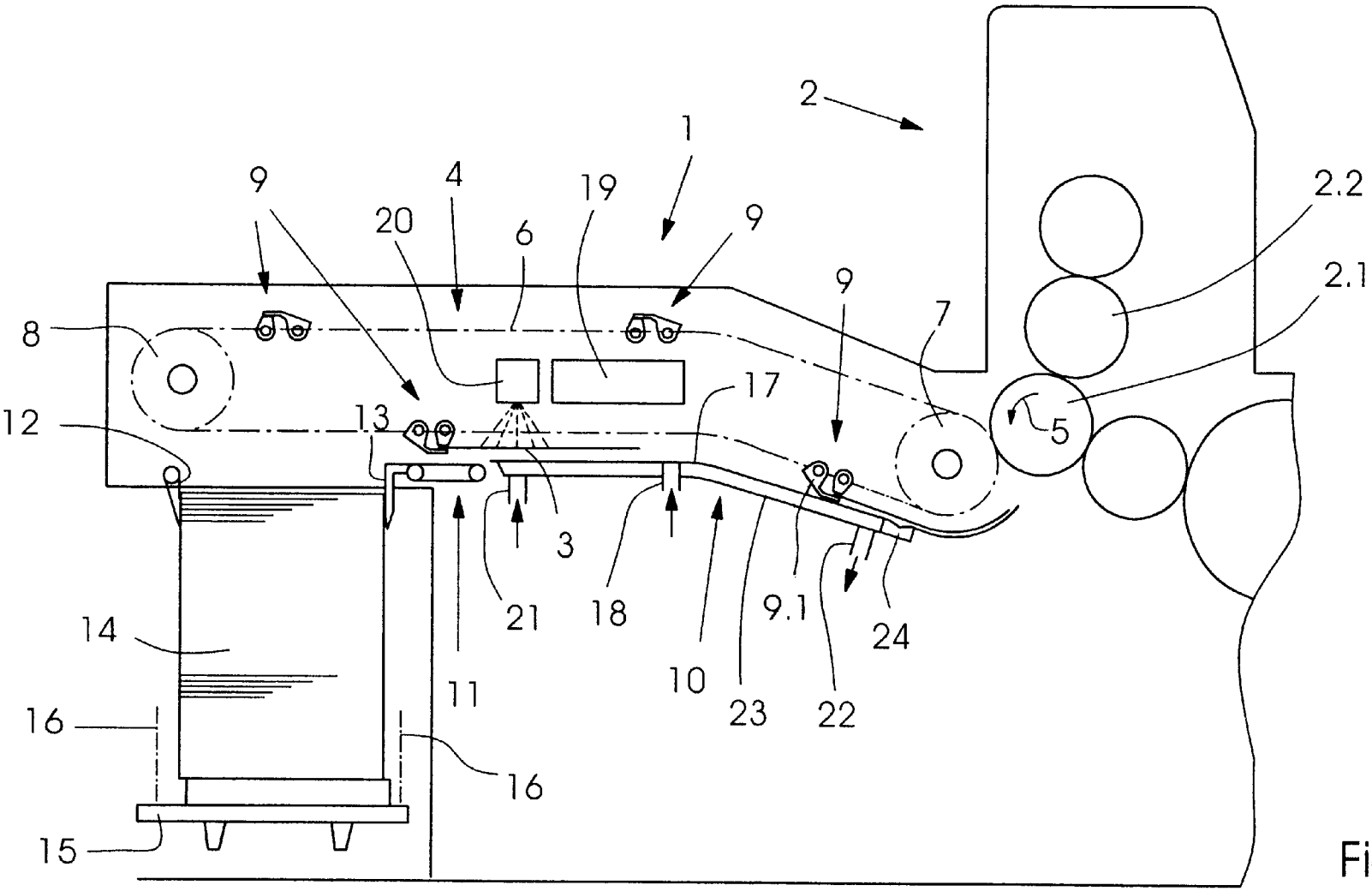
FIG. 1 is a fragmentary diagrammatic side elevational view of a sheet processing rotary printing machine showing a delivery thereof, as well as a sheet guiding device provided with a sheet decurler according to the invention.

Referring now to the drawings and, first, particularly to FIG. 1 thereof, there is shown therein a sheet-processing rotary printing machine including a delivery 1 following a last processing station. Such a processing station may be a printing unit or a post-treatment unit, such as a varnishing unit. In the example at hand, the last processing station is a printing unit 2 operating in the offset process and having an impression cylinder 2.1. The latter carries a respective sheet 3 in a processing direction indicated by the direction-of-rotation arrow 5 through a printing nip between the impression cylinder 2.1 and a blanket cylinder 2.2 cooperating therewith, and transfers the sheet 3, thereafter, to a chain conveyor 4 while opening non-illustrated grippers mounted on the impression cylinder 2.1 and provided for gripping the sheet 3 at a gripper edge located at the leading end thereof. The sheet conveyor 4 includes two conveyor chains 6, each of which revolves along a respective side wall of the delivery 1 during operation. Each of the conveyor chains 6, respectively, is looped or wrapped around one of two synchronously driven drive sprockets 7 having axes of rotation which are aligned with one another and, in the example at hand, the respective chain 6 is guided over a deflection or guide sprocket 8, respectively, located downline or downstream of the drive sprockets 7, as viewed in the processing direction. Between the two conveyor chains 6 there extend gripper systems 9 which are carried by the chains 6 and have grippers 9.1 which pass through gaps formed between the non-illustrated grippers arranged on the impression cylinder 2.1 and, in so doing, accept a respective sheet 3 by gripping the aforementioned gripper edge thereof at the leading end of the sheet 3 directly before the grippers arranged on the impression cylinder 2.1 open, transport the sheet over a sheet guiding device 10 to a sheet brake 11 and open thereat in order to transfer the sheet 3 thereto. The sheet brake 11 imparts to the sheets a deposition speed which is reduced with respect to the processing speed and, after the sheets have attained the deposition speed, releases the sheets, so that a respective, now retarded sheet 3, finally strikes against leading-edge stops 12 and, being aligned on the latter and on trailing-edge stops 13 located opposite thereto, forms together with preceding and/or following sheets 3 a sheet pile 14, which is lowerable by a lifting mechanism to an extent corresponding to the growth of the sheet pile 14. Of the lifting mechanism, FIG. 1 reproduces only a platform 15 carrying the sheet pile 14, and lifting chains 16 which carry the platform 15 and are represented in phantom.

The conveyor chains 6, along the paths thereof between the drive sprockets 7, on the one hand, and the deflection sprockets 8, on the other hand, are guided by chain guide rails, which thus determine the chain path of the chain strands. In the example at hand, the sheets 3 are transported by the lower chain strand in FIG. 1. That section of the chain path through which the chain strand passes is followed by a sheet guiding surface 17 which is formed on the sheet guiding device 10 and faces towards the chain strand. Between the sheet guiding surface 17 and the sheet 3, respectively, guided thereover, a supporting air cushion is preferably formed during operation. For this purpose, the sheet guiding device 10 is equipped with blast or blown-air nozzles which open into the sheet guiding surface 17, only one of the nozzles being reproduced in FIG. 1 as representative of all of the nozzles, and being symbolically represented at 18.

In order to prevent the printed sheets 3 in the sheet pile 14 from adhering or sticking to one another, a dryer 19 and a powdering device 20 are provided on the path of the sheets 3 from the drive sprockets 7 to the sheet brake 11.

In order to avoid excessive heating of the sheet guiding surface 17 by the dryer 19, a coolant circuit is integrated into the sheet guiding device 10, which is indicated symbolically in FIG. 1 by an inlet nozzle 21 and an outlet nozzle 22 of a coolant trough 23 associated with the sheet guiding surface 17.

The sheets 3 passing through the printing nip between the impression cylinder 2.1 and the blanket cylinder 2.2 adhere to the blanket cylinder 2.2, in particular, in printed areas of the sheets 3, after the sheets 3 leave the printing nip, so that the sheets 3 are initially entrained or carried along by the blanket cylinder 2.2 downstream of the printing nip and, after passing through an entraining path, are pulled back at a tear-off angle onto the outer surface of the impression cylinder 2.1. The thereby occurring bending of the sheets 3 which takes place at the tear-off point generally leads to a persistent deformation, which has an effect in the form of a curvature of the sheets occurring towards the printed areas of the sheet surface. In order to reverse this effect, a decurler or decurling device has been provided heretofore in the prior art and is generally integrated into the sheet guiding device 10 in an inlet region of the latter. Accordingly, in the case at hand, a sheet decurler 24 is installed at a location on the sheet guiding device 10, which follows a deflection region of the gripper systems 9 that is formed by the drive sprockets 7.

Figure 2:
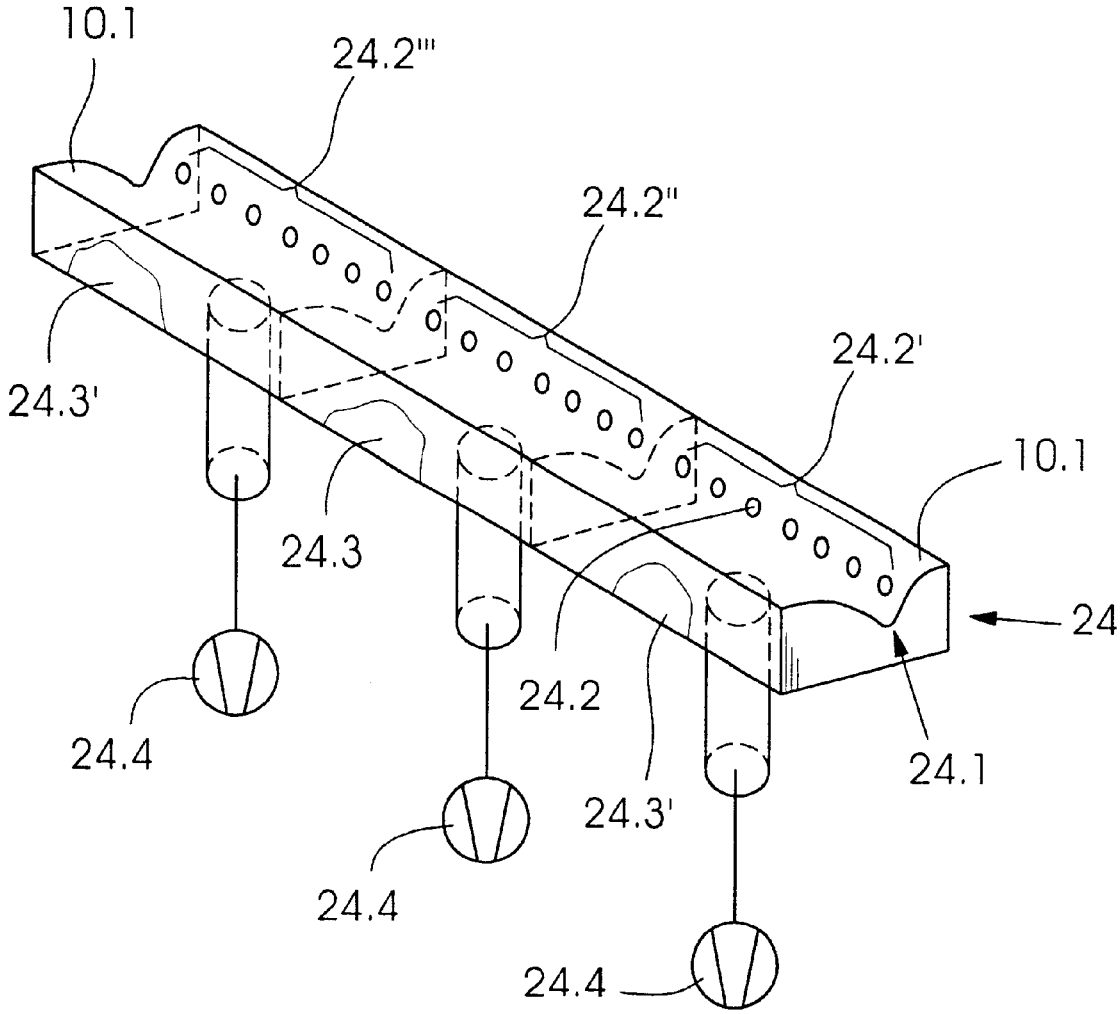
FIG. 2 is an enlarged fragmentary and simplified perspective view of FIG. 1 showing a first exemplary embodiment of the sheet decurler according to the invention, removed from the sheet guiding device, the sheet decurler having individual chambers and an evacuation system.

The sheet decurler 24, separated from the sheet guiding device 10 and illustrated diagrammatically in FIG. 2, comprises a guide surface section 10.1 formed with a decurling notch 24.1, over which the sheets 3 are drawn by the revolving gripper systems 9. Provided along the decurling notch 24.1 are suction openings 24.2, which penetrate the guide surface section 10.1 and are fluidically connected to an evacuation system which, although, in fact, constructed differently depending upon the refinement of the subject of the invention, in principle has a plurality of chambers 24.3, 24.3', wherein there terminate suction openings 24.2 which are provided in the decurling notch 24.1 and penetrate the guide surface section 10.1, the suction openings 24.2 forming successive groups 24.2', 24.2" and 24.2'", and one of the chambers 24.3, 24.3' being assigned to a respective one of the groups 24.2', 24.2" and 24.3'".

In the construction illustrated in FIG. 2, a first embodiment of the evacuation system comprises a number of vacuum generators 24.4 corresponding to the number of chambers 24.3, 24.3' and respectively having a controllable pressure gradient. In each case, one of these vacuum generators 24.4 is connected to a respective one of the chambers 24.3, 24.3', so that equal or unequal negative pressures can selectively or optionally be set in the chambers 24.3 and 24.3'.

The illustration of three chambers in FIG. 2 is purely exemplary. However, a particularly good ability to adapt the device according to the invention to an extremely wide range of print jobs results in a construction thereof having a very large number of groups of suction openings and a corresponding number of chambers which communicate with a respective one of the groups of suction openings, to which, respectively, a vacuum generator is then assigned.

Control of the pressure gradient is effected alternatively by changing the respective suction performance of the vacuum generators 24.4 or by respectively connecting an adjustable throttle upstream from a vacuum generator.

Figure 3:
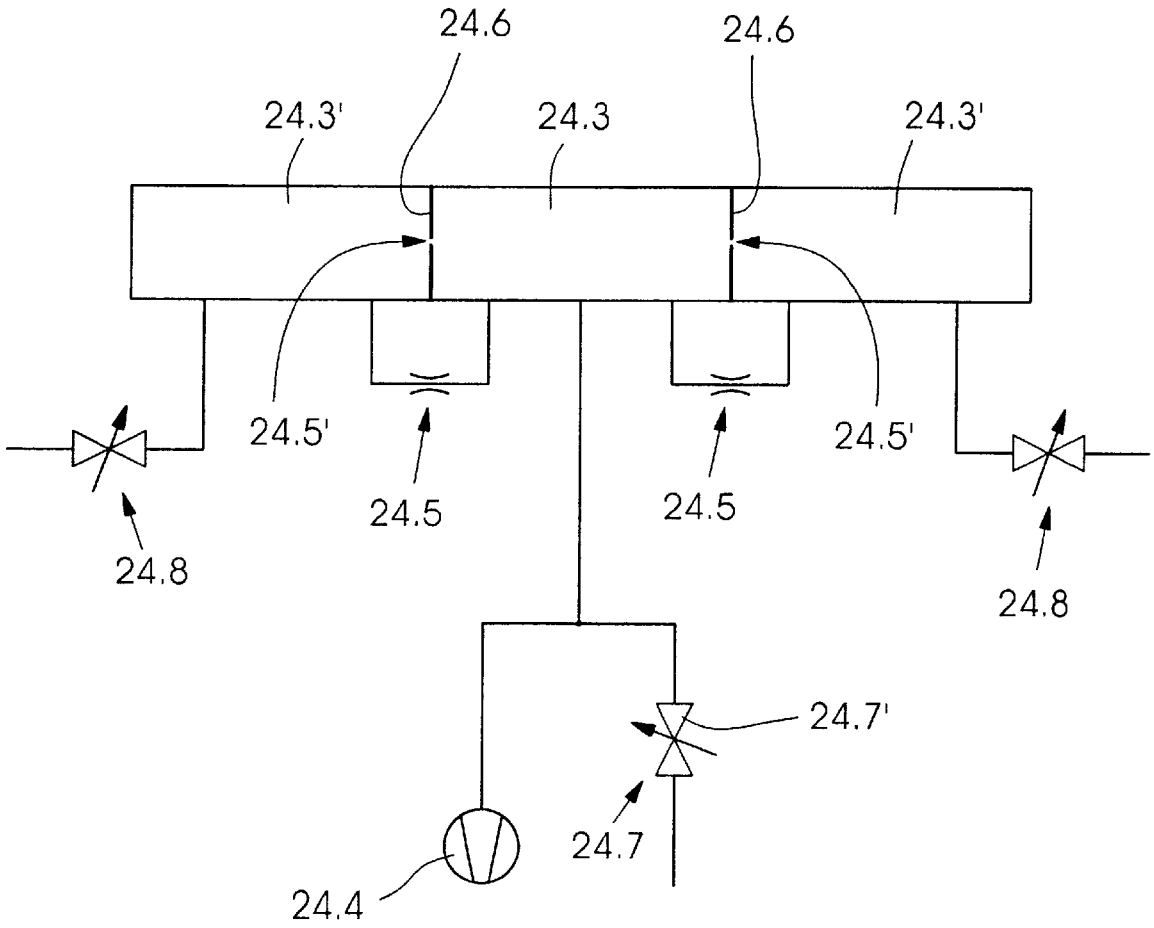
FIG. 3 is a diagrammatic and schematic view of a second exemplary embodiment of the sheet decurler according to the invention, showing the chambers and the evacuation system thereof.

In FIG. 3, a construction of the device according to the invention is reproduced which is suitable, in particular, for three groups of suction openings and three chambers 24.3, 24.3' assigned thereto, wherein the evacuation system merely requires one vacuum generator 24.4 and can, therefore, be produced more cost-effectively than in the case of the construction according to FIG. 2, assuming an equal number of chambers in both cases.

The construction according to FIG. 3 includes a central chamber 24.3 and a respective outer chamber 24.3' on each side thereof. Of these chambers, respectively, mutually adjacent chambers 24.3 and 24.3' on each side are connected to one another via a throttle 24.5 which, in a first construction, is inserted into the lines connecting the mutually adjacent chambers or, in another construction, are provided as throttle bores 24.5' formed in respective chamber walls 24.6 separating each of the respective chambers 24.3' from the central chamber 24.3. The central chamber 24.3 is connected to a controllable vacuum generator 24.4 or to a vacuum generator and a bypass 24.7 which is open to the atmosphere, and in which a controllable valve 24.7' is inserted. A respective outer chamber 24.3' is connected to atmosphere via a respective further controllable valve 24.8.

With these constructions, in the event of complete coverage of the chambers 24.3 and 24.3' by a sheet 3 in a closed state of the controllable valves 24.8 associated with the outer chambers 24.3', the same negative pressure prevails in all of the chambers during operation, the magnitude of the negative pressure being variable by the controllable valve 24.7' inserted into the bypass 24.7 and, in the case wherein the vacuum generator 24.4 is constructed with a controllable pressure gradient, by varying the latter.

In the outer chambers 24.3', it is possible to achieve smaller negative pressures than in the central chamber 24.3 by admitting ambient air deliberately into the outer chambers 24.3' via the controllable valves 24.8. The negative pressures prevailing in the outer chambers 24.3' can be set to different magnitudes by introducing different volume flows by opening the controllable valves 24.8 to greater or lesser extents.

In the case of an appropriately small extent of a chamber arrangement according to FIG. 3 in the longitudinal direction of the decurling notch 24.1, the configuration reproduced in FIG. 3 can be provided repeatedly in the longitudinal direction of the decurling notch 24.1, so that a sheet decurler with a plurality of zones is obtained, each of which develops decurling effects which can be influenced individually.

Figure 4:
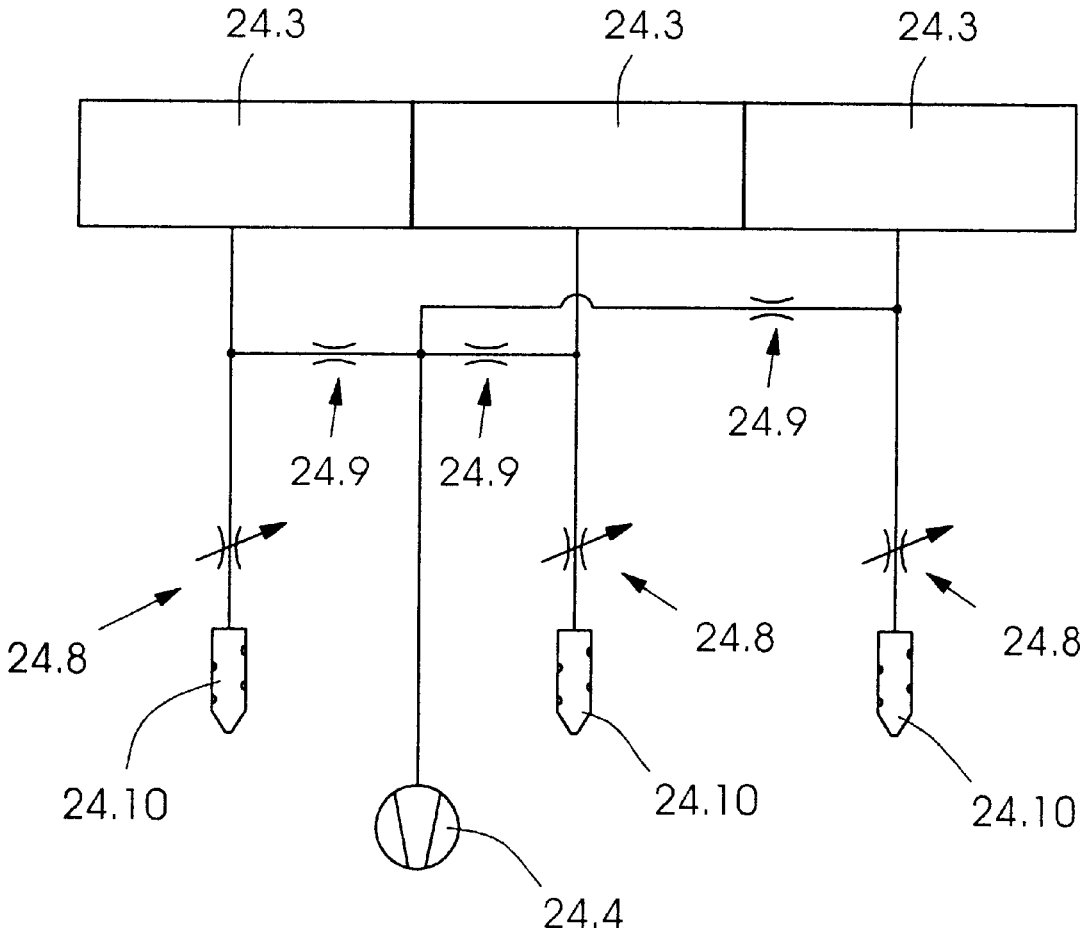
FIG. 4 is a view similar to that of FIG. 3 of a third exemplary embodiment of the sheet decurler according to the invention, showing the chambers and the evacuation system thereof.

The configuration according to FIG. 4 includes, only by way of example, three chambers 24.3, into which, respectively, one group of the aforementioned suction openings 24.2 opens, and an evacuation system, which needs only one vacuum generator 24.4 for, in particular, even more than three chambers. In this regard, a respective one of the chambers 24.3 is connected via a respective throttle or restrictor 24.9 to a vacuum generator 24.4 that is common to the chambers 24.3 and, respectively, to a bypass that is open to the atmosphere and into which a respective controllable valve 24.8 is inserted.

In the construction according to FIG. 4, the negative pressure can be set individually in each of the chambers 24.3 by admitting or spilling in volume flows which can be selected, by the respective controllable valves 24.8, from the surroundings. In this case, too, a vacuum generator with a controllable pressure gradient is preferably provided. A respective air filter 24.10 is advantageously connected upstream from the controllable valves 24.8.

We claim:

1. A device for decurling flat printing materials for a machine for processing the printing materials, comprising a guide surface section whereover the printing materials are drawable, said guide surface section being formed with a decurling notch, and with suction openings arranged along and in said decurling notch and penetrating said guide surface section, and an evacuation system fluidically connected to said suction openings, said suction openings being formed in successive groups thereof, and said evacuation system including a plurality of chambers, of which respective chambers are assigned to a respective one of said groups of suction openings, said chambers being selectively settable with at least one of equal and unequal negative pressures therein during operation.

2. The decurling device according to claim 1, further comprising a vacuum generator assigned to each of said chambers, said vacuum generator having a controllable gradient.

3. The decurling device according to claim 1, wherein said chambers include a central chamber and an outer chamber on each side thereof, mutually adjacent chambers of said central and said outer chambers being connected to one another via a throttle, the decurling device further comprising a vacuum generator connected to said central chamber, and controllable valves, respectively, via which each of said outer chambers is connected to atmosphere.

4. The decurling device according to claim 3, wherein said vacuum generator has a controllable vacuum gradient.

5. The decurling device according to claim 3, wherein said central chamber connected to said vacuum generator is also connected to a bypass open to the atmosphere and having one of said controllable valves inserted therein.

6. The decurling device according to claim 1, wherein a respective one of said chambers is connected via a throttle to a vacuum generator common to said chambers and, respectively, to a bypass open to atmosphere, a controllable valve, respectively, being inserted into the respective bypass.

7. A machine for processing flat printing materials having a device for decurling flat printing materials in the machine, comprising a guide surface section whereover the printing materials are drawable, said guide surface section being formed with a decurling notch, and with suction openings arranged along and in said decurling notch and penetrating said guide surface section, and an evacuation system fluidically connected to said suction openings, said suction openings being formed in successive groups thereof, and said evacuation system including a plurality of chambers, of which respective chambers are assigned to a respective one of said groups of suction openings, said chambers being selectively settable with equal and unequal negative pressures therein during operation.

8. The decurling device according to claim 1, wherein the printing materials are printed sheets, and the machine for processing the printing materials is a sheet-processing rotary printing machine.

* * * * *